US011066804B2

(12) United States Patent
Bayless et al.

(10) Patent No.: US 11,066,804 B2
(45) Date of Patent: Jul. 20, 2021

(54) PERIMETER DRAIN

(71) Applicant: Alabama Foundation Specialists, Inc., Huntsville, AL (US)

(72) Inventors: Benjamin Bayless, Chattanooga, TN (US); James Andrew Burran, Chattanooga, TN (US); Michael Cox, Chattanooga, TN (US)

(73) Assignee: AFS Newco, LLC, Virginia Beach, VA (US)

( * ) Notice: Subject to any disclaimer, the term of this patent is extended or adjusted under 35 U.S.C. 154(b) by 0 days.

(21) Appl. No.: 16/748,925

(22) Filed: Jan. 22, 2020

(65) Prior Publication Data

US 2020/0240100 A1 Jul. 30, 2020

Related U.S. Application Data

(60) Provisional application No. 62/796,205, filed on Jan. 24, 2019.

(51) Int. Cl.
*E02D 31/02* (2006.01)
*E04B 1/70* (2006.01)

(52) U.S. Cl.
CPC ..... *E02D 31/02* (2013.01); *E04B 1/7023* (2013.01)

(58) Field of Classification Search
CPC ..... E04B 1/7023; E02D 31/02; E02D 31/06; E02B 11/005; E01C 11/227; E01C 11/228; E04D 13/0445; E04F 2019/044
USPC ..... 52/169.5; 404/2
See application file for complete search history.

(56) References Cited

U.S. PATENT DOCUMENTS 3,876,322 A * 4/1975 Deason ..... E04B 1/6804 404/2
4,490,067 A * 12/1984 Dahowski ..... E01C 11/227 404/4
5,474,400 A * 12/1995 Kliefoth ..... E02D 31/00 405/229
5,501,044 A * 3/1996 Janesky ..... E04B 1/7023 404/4
7,507,054 B2 * 3/2009 Fithian ..... E03F 3/046 264/219
D881,359 S * 4/2020 Hunter ..... D23/267
2007/0044396 A1 * 3/2007 Janesky ..... E02D 31/02 52/169.5
2008/0190045 A1 * 8/2008 Janesky ..... E02D 31/02 52/169.5
2013/0014447 A1 * 1/2013 Blank ..... E02D 31/02 52/1

* cited by examiner

*Primary Examiner* — Christine T Cajilig
(74) *Attorney, Agent, or Firm* — Jeremy A. Smith; Lanier Ford Shaver & Payne, PC

(57) ABSTRACT

The present disclosure provides a water drainage system comprising: a plurality of lengths of drain pipe comprising a channel and a vertical wall, wherein (i) the vertical wall comprises one or more standoffs extending horizontally from the vertical wall and (ii) wherein the drain pipe comprises a top edge and a bottom edge, each of the top and bottom edges being bifurcated by a v-shaped notch.

17 Claims, 7 Drawing Sheets

PERIMETER DRAIN

CROSS REFERENCE TO RELATED APPLICATIONS

This application claims priority to and the benefit of pending U.S. Provisional Patent Application No. 62/796,205 filed on Jan. 24, 2019.

BACKGROUND AND SUMMARY

Perimeter drain systems are used to collect and drain water from basements and crawl spaces. A perimeter drain is installed around the perimeter of a basement, for example, and is typically recessed beneath a concrete pad. Standoffs create a gap at the wall that allows water to drain into a perimeter drain.

The perimeter drain of the present disclosure improves upon known perimeter drains by providing a drain with a unique shape that allows water to enter the drain on multiple sides. Further, the design of the drain provides for modular accessories that easily customize the perimeter drain to the user's specifications. For example, a clip connects adjacent perimeter drain segments together, and a corner piece navigates the corners of the drain. An outlet directs water from the drain to a reservoir or collection system. An inspection port allows a user to inspect the drain to detect the presence of water.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
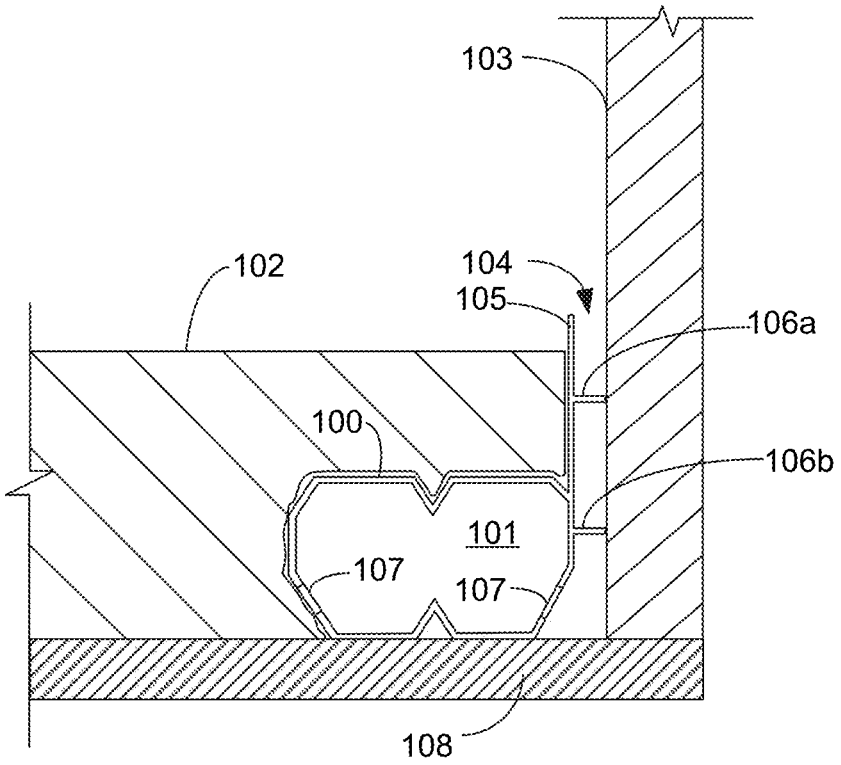
FIG. 1 is a cross-sectional view of a perimeter drain according to an exemplary embodiment of the present disclosure

FIG. 1 is a cross-sectional view of a drain 100 according to an exemplary embodiment of the present disclosure. The drain 100 defines a channel 101 through which water (not shown) is drained from a room, such as a basement. The drain 100 is typically installed along the rails 103 of a basement and is set atop the ground or foundation 108. A concrete floor 102 can then be poured on top of the drain 100 to recess the drain 100 into the foundation.

A plurality of standoffs 106*a* and 106*b* maintain the drain 100 spaced apart from the wall 103, creating a gap 104 between the wall 103 and the floor 102. The standoffs 106*a* and 106*b* extend from a vertical wall 105 of the drain 100 and comprise openings (not shown) that allow water (not shown) to enter into the gap 104, and then to enter the channel 101 via a plurality of openings 107 in the drain 100. The channel 101 of the drain 100 then directs water to a reservoir (not shown) or other water removal system to prevent flooding.

Figure 2:
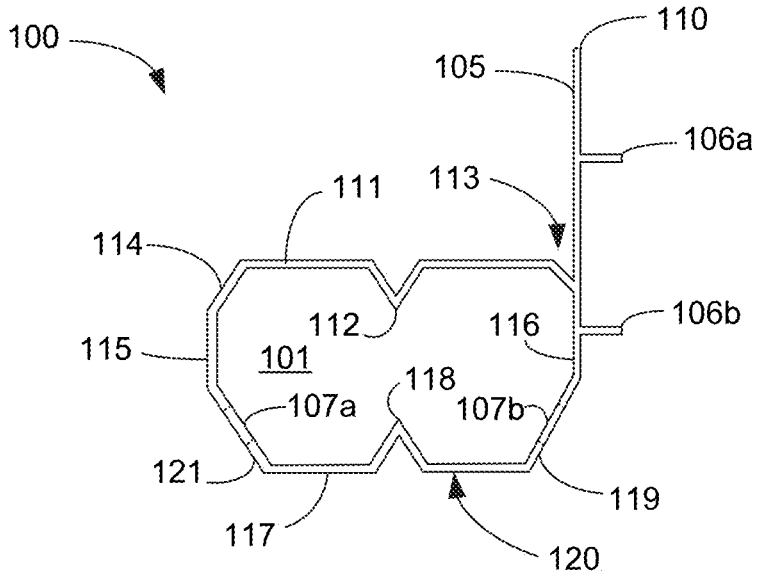
FIG. 2 is an end view of a perimeter drain according to an exemplary embodiment of the present disclosure.

FIG. 2 is an end view of the drain 100 of FIG. 1. The drain 100 comprises a channel 101 formed within a main body 120. The main body 120 comprises a substantially horizontal top edge 111, a substantially horizontal bottom edge 117, a substantially vertical outer edge 116, and a substantially vertical inner edge 115.

The horizontal top edge 111 and horizontal bottom edge 117 are each bifurcated by a V-shaped notch 112 and 118, respectively. In this regard, the V-shaped notch 112 extends downwardly from the horizontal top edge 111 in a middle of the horizontal top edge 111. The V-shaped notch 118 extends upwardly from the horizontal bottom edge 117 in a middle of the horizontal bottom edge 117.

An upper inner angled portion 114 extends between the top edge 111 and the inner edge 115. An upper outer angled portion 113 extends between the top edge 111 and the outer edge 116. A lower outer angled portion 119 extends between the outer edge 116 and the bottom edge 117. A lower inner angled portion 21 extends between the bottom edge 117 and the inner edge 115.

The lower outer angled portion 119 and the lower inner angled portion 121 each comprise a plurality of openings 107*b* and 107*a*, respectively, that extend through the angled portions 119 and 121 to allow water (not shown) to enter the channel 101. The openings 107*a* and 107*b* are generally circular holes cut through the angled portions.

A vertical wall 105 extends upwardly from the outer edge 116 and is coextensive with the outer edge 116 in the illustrated embodiment. The vertical wall 105 terminates at an upper end 110. The vertical wall 105 is substantially vertical in the illustrated embodiment The standoffs 106*a* and 106*b* extend generally perpendicular to the vertical wall 105. In one embodiment, the drain 100 has a width of substantially 4.410 inches from the standoffs 106*a* and 106*b* to the inner edge 115, and a height of substantially 4.5 inches from the bottom edge 117 to the upper end 110 of the vertical wall 105. The drain may be differently sized in different embodiments.

In one embodiment, the drain 100 is formed from extruded PVC. In other embodiments, the drain 100 may be formed from other suitable materials. The drain 100 is formed in sections often feet in length in one embodiment. Adjacent drain sections are joined together with a clip (not shown), as further discussed below.

Figure 3:
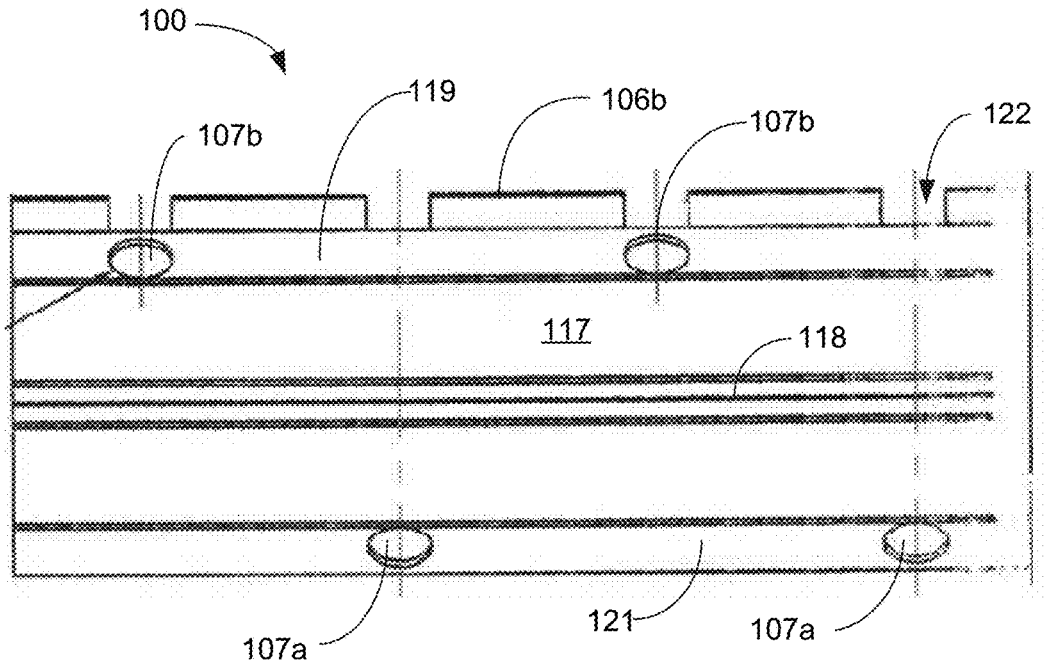
FIG. 3 is a bottom view of the drain of FIG. 2.

FIG. 3 is a bottom view of the drain 100 of FIG. 2. The V-shaped notch 118 bifurcates the bottom edge 117 as discussed above. A plurality of openings 107*a* are disposed in the lower inner angled portion 121, and the plurality of openings 107*b* are disposed in the lower outer angled portion 119. The openings 107*a* and 107*b* comprises holes of 35 inch diameter in one embodiment.

In the illustrated embodiment, the openings 107*a* are not aligned with the openings 107*b*. The openings 107*a* are spaced generally six inches apart from one another in this embodiment, and the openings 107*b* are spaced generally six inches apart from one another. Further, the openings 107*a* are spaced generally three inches from the openings 107*b* (in a longitudinal direction) in the illustrated embodiment.

The standoffs 106*b* (and 106*a*, FIG. 2) are not continuous, but rather comprise gaps 122 to allow water (not shown) to drain into the channel 101 (FIG. 2).

Figure 4:
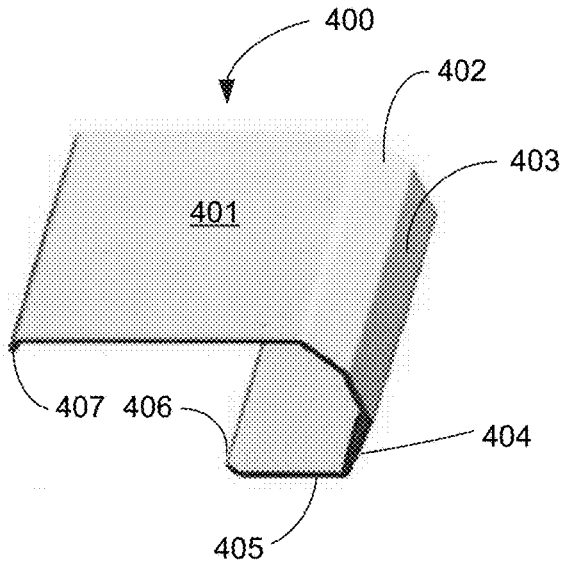
FIG. 4 is a top perspective view of a clip according to an exemplary embodiment of the present disclosure.

FIG. 4 is a top perspective view of a clip 400 according to an exemplary embodiment of the present disclosure. The clip 400 is used to connect adjacent lengths of drain 100 (FIG. 1) together. The clip 400 comprises a substantially horizontal top edge 401, an upper angled portion 402, a substantially vertical side edge 403, a lower angled portion 404, and a lower horizontal portion 405. A lower clip portion 406 angles upwardly from the lower horizontal portion 405 to secure the clip 400 to the drain 100, as further discussed with reference to FIG. 5 below. An upper clip portion 407 angles downwardly from the top edge 401 to further secure the clip 400 to the drain 100.

Figure 5:
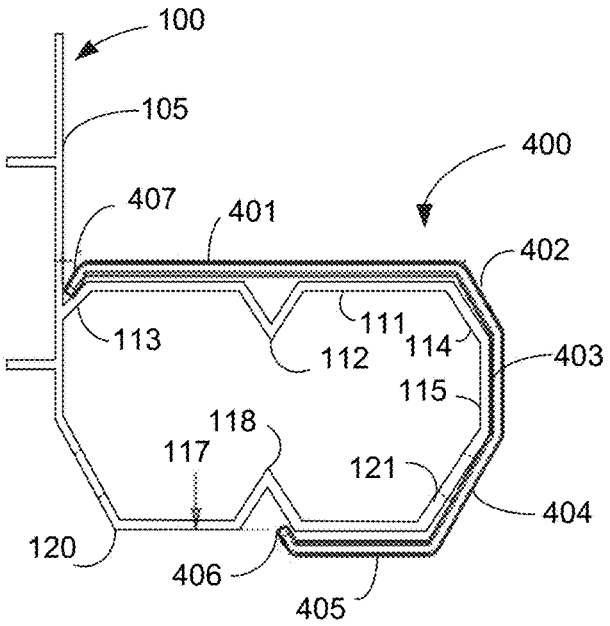
FIG. 5 is a side view showing the clip of FIG. 4 attached to the drain.

FIG. 5 is a side view showing the clip 400 of FIG. 4 attached to the drain 100. When the clip 400 is properly attached, the top edge 401 is adjacent to and above the top edge 111 of the drain 100. The upper clip portion 407 is adjacent to and frictionally fits with the upper outer angled portion 113 of the drain 100. The upper angled portion 402 of the clip 400 is adjacent to and above the upper inner angled portion 114. The substantially vertical side edge 403 of the clip 400 is adjacent to the inner edge 115. The lower angled portion 404 of the clip 400 is adjacent to and below the lower inner angled portion 121 of the drain 100. The lower horizontal portion 405 of the clip 400 is adjacent to and below the bottom edge 117 of the drain 100. The lower clip portion 406 frictionally fits within the lower V-shaped notch 118.

The frictional fit of the lower clip portion 406 within the lower V-shaped notch 118 and the upper clip portion 407 within a notched formed between the upper outer angled portion 113 of the drain 100 and the wall 105 of the drain 100 secures the clip 400 to the main body 120 of the drain 100, and in this manner the clip 400 secures adjacent segments of drain 100 together.

The clip 400 is formed from plastic in one embodiment. However, other materials may be used for forming the clip 400 provided that the material has enough flexibility for the clip 400 to frictionally fit over the drain 100 while securing adjacent segments of drain together.

Figure 6:
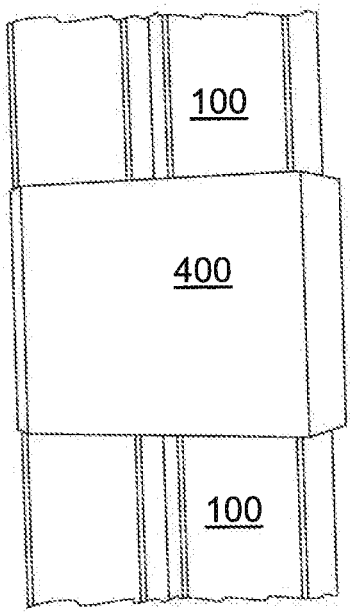
FIG. 6 depicts a clip secured over and connecting two lengths of drain together, where the lengths of drain are adjacent to one another.

FIG. 6 depicts a clip 400 secured over and connecting two lengths of drain 100 together, when the lengths of drain 100 are adjacent to one another.

Although as described above, in one embodiment the clip 400 is secured via a frictional fit, it is possible that the clip 400 could be glued, mechanically attached or be adapted and configured to slip over two (2) lengths of drain 100. Accordingly, each of these mechanisms of securing the clip 400 should be considered within the scope of this disclosure.

Figure 7B:
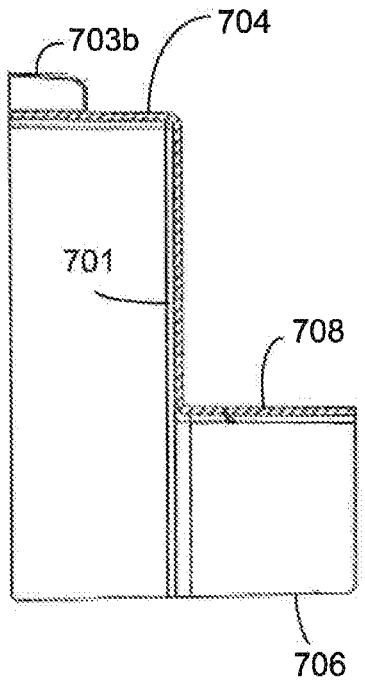
FIG. 7B is a cross sectional view of the corner piece of FIG. 7A, taken along section lines A-A of FIG. 7A.
Figure 7A:
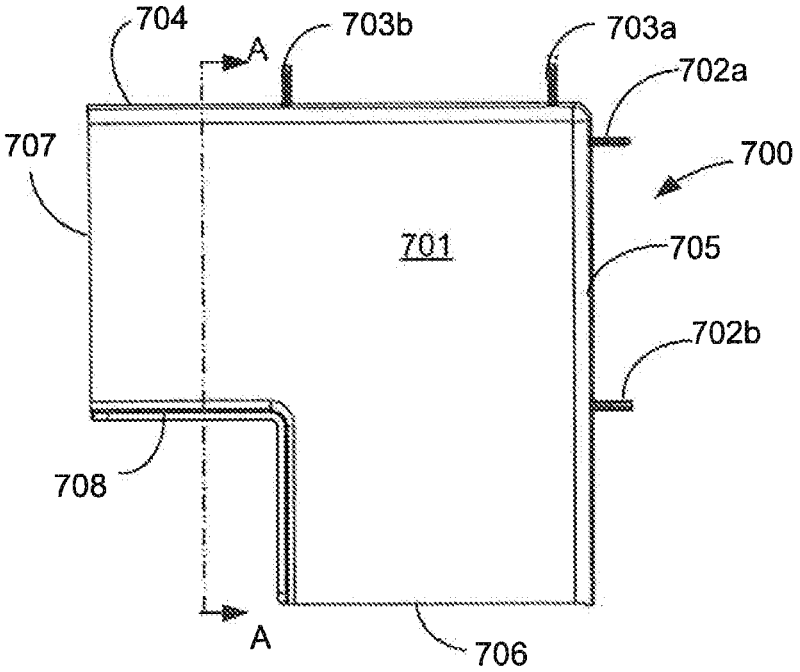
FIG. 7A is a top view of a corner piece for connecting two lengths of drain together in a corner.

FIG. 7*a* is a top view of a corner piece 700, the corner piece 700 installed for navigating a corner, where two lengths of drain 100 (FIG. 1) meet in a corner. The corner piece 700 comprises a flat surface 701 that fits atop the top edge 111 (FIG. 2) of the drain 100. Standoffs 702*a* and 702*b* extend from a first outer wall 705 of the corner piece 700. The standoffs 702*a* and 702*b* maintain the first outer wall 705 at a substantially similar distance from the room wall (not shown) as the standoffs 106*a* and 106*b* (FIG. 1) maintain the wall 105 of the drain 100. In other words, the wall 105 of the drain 100 is substantially coextensive with the first outer wall 705 of the corner piece 700 when the corner piece 700 is installed.

Similarly, standoffs 703*a* and 703*b* extend from a second outer wall 704 of the corner piece 700. The standoffs 703*a* and 703*b* maintain the second outer wall 704 at a substantially similar distance from the room wall as the standoffs 106*a* and 106*b*. In this manner, a uniform gap 104 (FIG. 1) is maintained around the edges of the room wall 103, even in the corners of the room.

Further, the first outer wall 705 and second outer wall 704 extend upwardly from the flat surface 701 a distance generally equal to the distance that the wall 105 (FIG. 1) extends upwardly from the drain 100 (FIG. 1). This configuration is desired so that the first outer wall 705 and second outer wall 704 form in the corner a continuous wall for bounding the concrete floor 102 (FIG. 1) that is typically poured on top of the drain 100, as discussed above with respect to FIG. 1.

An inner corner 708 of the corner piece 700 extends downwardly from the flat surface 701 such that the inner corner 708 is adjacent to the substantially vertical inner edge 115 when installed, as is further shown in FIG. 7B.

Flat edge 706 extends between the first wall 705 and the inner corner 708, and flat edge 707 extends between the second wall 704 and the inner corner 708.

FIG. 7B is a cross sectional view of the corner piece 700 of FIG. 7A, taken along section lines A-A of FIG. 7A. As can be seen in the figure, the inner corner 708 extends downwardly from the flat surface 701. Further, the second wall 704 extends upwardly from the flat surface 701.

Figure 7C:
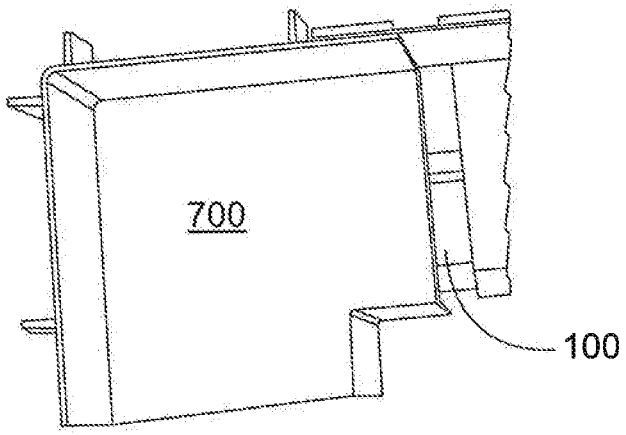
FIG. 7C is a top view of the corner piece 700 installed on a drain 100.
Figure 7D:
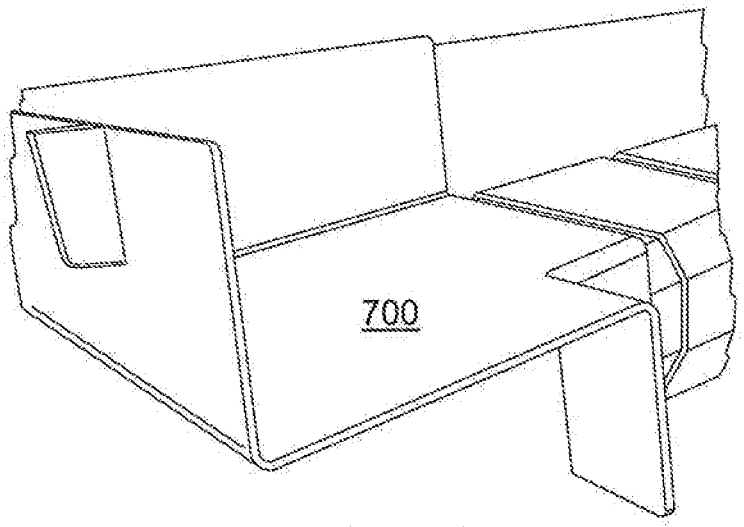
FIG. 7D is a perspective view of the corner piece 700 installed on a drain 100.

FIG. 7C is a top view of the corner piece 700 installed on a drain 100. FIG. 7D is a perspective view of the corner piece 700 installed on a drain 100.

Figure 8A:
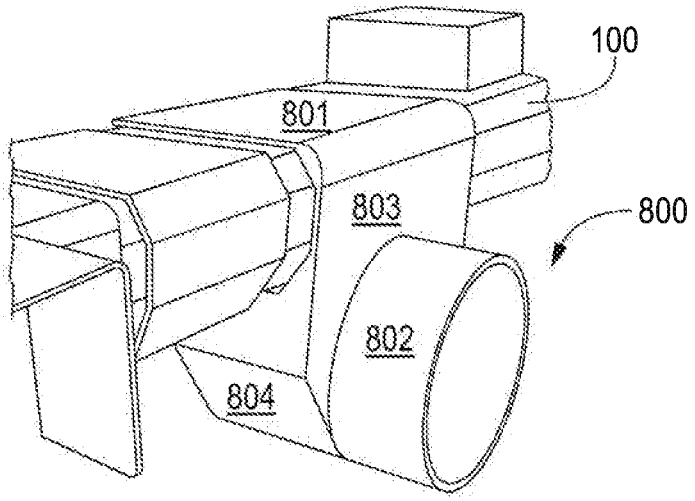
FIG. 8A is a front perspective view of an outlet installed on a drain.

FIG. 8A is a front perspective view of an outlet 800 installed on a drain 100. The outlet directs water from the drain 100 to a reservoir or basin (not shown) or elsewhere for storage or removal. The outlet 800 clips over the drain 100 via an upper clip portion 801 which fits over the top edge 111 (FIG. 2) of the drain. The upper clip portion 801 extends generally horizontally. A front wall 803 extends downwardly and generally perpendicularly from the upper lip portion 801. Water from the drain 100 exits the drain via an opening (not shown) in the drain and into a bottom portion 804 of the outlet 800. The water exits the outlet 800 via a cylindrical portion 802 at the front of the outlet 800.

Figure 8B:
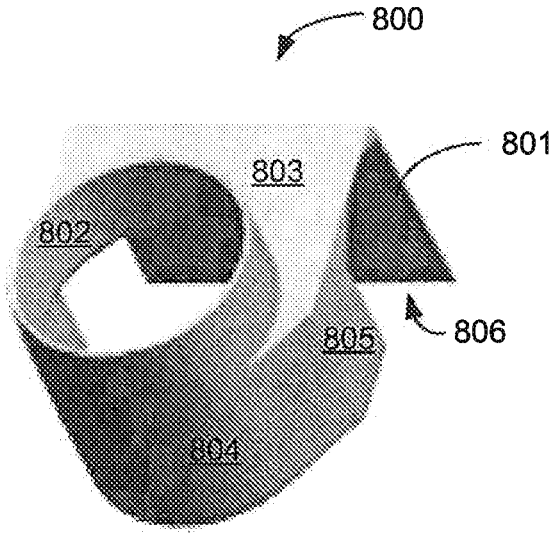
FIG. 8B is a bottom perspective view of the outlet of FIG. 8A.

FIG. 8B is a bottom perspective view of the outlet 800 of FIG. 8A. The clip portion 801 extends back from the front wall 803 and defines a space 806 for clipping over the drain 100 (FIG. 2). The space 806 is generally sized to receive the drain 100 and retain the outlet 800 on the drain 100.

Figure 8C:
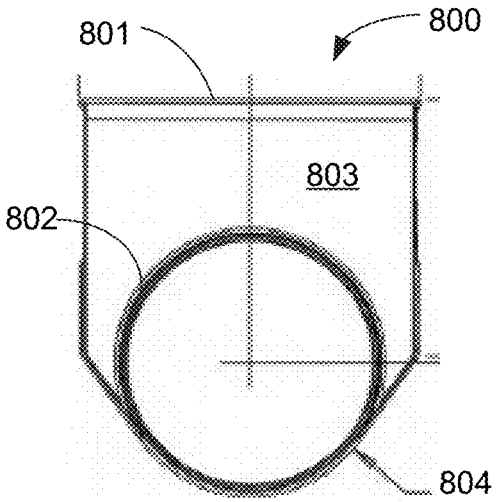
FIG. 8C is a front plan view of the outlet of FIG. 8A.
Figure 8D:
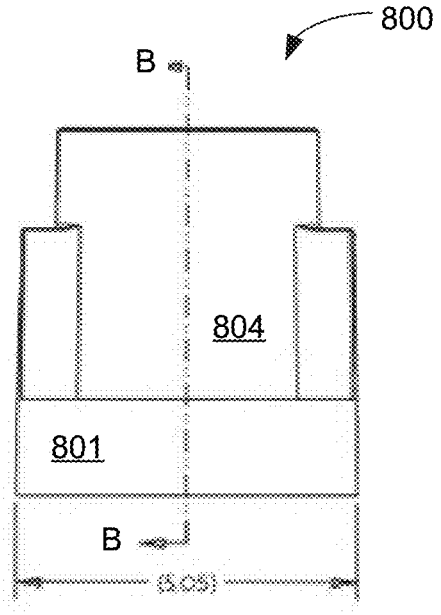
FIG. 8D is a bottom plan view of the outlet of FIG. 8A.
Figure 8E:
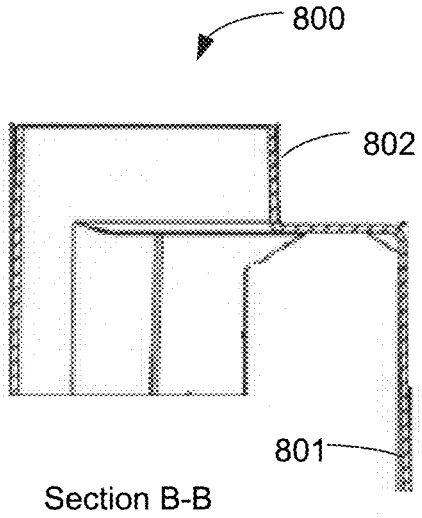
FIG. 8E is a cross sectional view of the outlet of FIG. 8D, taken along section lines B-B of FIG. 8D.

FIG. 8C is a front plan view of the outlet 800 of FIG. 8A. The cylindrical portion 802 is about four inches in diameter in one embodiment. FIG. 8D is a bottom plan view of the outlet 800 of FIG. 8A. FIG. 8E is a cross sectional view of the outlet 800 of FIG. 8D, taken along section lines B-B of FIG. 8D.

Figure 9A:
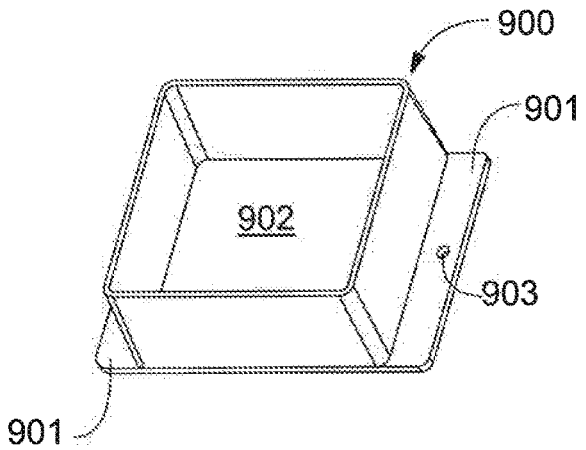
FIG. 9A is a top perspective view of an inspection port according to an exemplary embodiment of the present disclosure.

FIG. 9 is a top perspective view of an inspection port 900 according to an exemplary embodiment of the present disclosure. The inspection port 900 installs on the top edge 111 (FIG. 2) of the drain 100, and allows a user to inspect inside the drain 100 to detect the presence of water through a central opening 902 in the inspection port 900. In this regard, the top edge 111 of the drain 100 is cut away in the area of the central opening, and the inspection port 900 is installed over the cut-away portion. Opposed flanges 901 comprise openings 903 (only one of which is shown in FIG. 9A) for receiving fasteners which releasably affix the inspection port 900 to the drain 100.

Figure 9B:
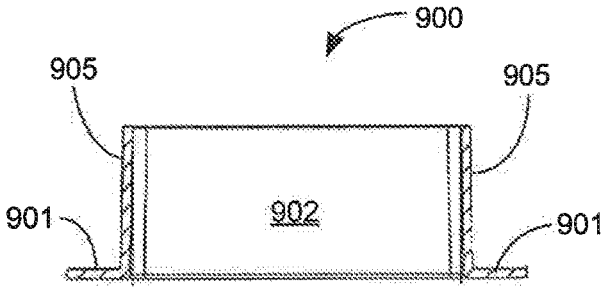
FIG. 9B is a cross-sectional view of the inspection port of FIG. 9A.

FIG. 9B is a cross-sectional view of the inspection port 900 of FIG. 9A. Walls 905 extend upwardly from the opposed flanges 901 and define the square-shaped central opening 902. The walls 905 are sufficiently high to allow a concrete floor to be poured over the drain 100 without entering the inspection port 900.

Figure 10A:
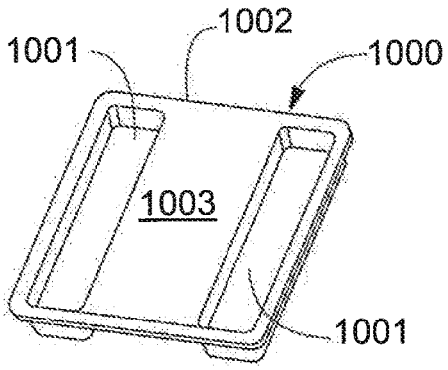
FIG. 10A is a top perspective view of an inspection cap according to an exemplary embodiment of the present disclosure.

FIG. 10A is a top perspective view of an inspection cap 1000 according to an exemplary embodiment of the present disclosure. The inspection cap 1000 comprises a perimeter 1002 sized to be received within the central opening 902 (FIG. 9A) of the inspection port 900. In this regard, the inspection cap 1000 covers the inspection port 900 when the inspection port 900 is not in use.

The inspection cap 1000 comprises opposed grooves 1001 extending downwardly from a top surface 1003 of the inspection cap 1000. The grooves 1001 allow a user (not shown) to lift the cap 1000 from the central opening 902 of the inspection port 900. In this regard, the grooves 1001 receive the user's fingers for grasping the cap 1000.

Figure 10B:
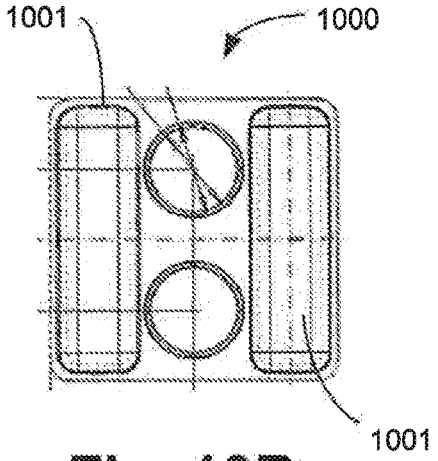
FIG. 10B is a top plan view of the inspection cap of FIG. 10A.

FIG. 10B is a top plan view of the inspection cap 1000 of FIG. 10A.

The invention claimed is:

1. A water drainage system comprising: a plurality of lengths of drain pipe comprising a channel and a vertical wall, wherein (i) the vertical wall comprises one or more standoffs extending horizontally from the vertical wall; (ii) wherein the drain pipe comprises a top edge and a bottom edge, each of the top and bottom edges being bifurcated by a v-shaped notch; (iii) wherein lengths of adjacent drain pipe are connected to one another via a frictional fitted clip positioned at the end of two (2) lengths of drain pipe; and (iv) wherein a portion of the clip is disposed within either of the v-shaped notches formed on the drain pipe.

2. The water drainage system of claim 1 comprising the one or more standoffs in at least two (2) vertically displaced rows.

3. The water drainage system of claim 2 wherein the one or more standoffs are not continuous along a length of drain pipe.

4. The water drainage system of claim 3 wherein the clip is glued to the lengths of adjacent drain pipe.

5. The water drainage system of claim 1 wherein the v-shaped notches on each of the top and bottom edges form two (2) channels in the interior of the drain pipe.

6. The water drainage system of claim 1 wherein the drain pipe is formed from extruded PVC.

7. The water drainage system of claim 1 wherein a portion of the clip is disposed within the lower v-shaped notch formed on the drain pipe and a portion of the clip is frictionally engaged with the upper outer angled of the drain pipe.

8. A water drainage system comprising: a plurality of lengths of drain pipe comprising a channel and a vertical wall, wherein (i) the vertical wall comprises one or more standoffs extending horizontally from the vertical wall; (ii) wherein the drain pipe comprises a top edge and a bottom edge, each of the top and bottom edges being bifurcated by a v-shaped notch; (iii) wherein lengths of adjacent drain pipe are connected to one another via a frictional fitted clip positioned at the end of two (2) lengths of drain pipe; and (iv) wherein a portion of the clip is disposed within the lower v-shaped notch formed on the drain pipe and a portion of the clip is frictionally engaged with the upper outer angled of the drain pipe.

9. The water drainage system of claim 8 comprising the one or more standoffs in at least two (2) vertically displaced rows.

10. The water drainage system of claim 8 wherein the one or more standoffs are not continuous along a length of drain pipe.

11. The water drainage system of claim 8 wherein the drain pipe is formed from extruded PVC.

12. The water drainage system of claim 9 wherein the drain pipe is formed from extruded PVC.

13. The water drainage system of claim 10 wherein the drain pipe is formed from extruded PVC.

14. A water drainage system comprising: a plurality of lengths of extruded PVC drain pipe comprising a channel and a vertical wall, wherein (i) the vertical wall comprises one or more standoffs extending horizontally from the vertical wall; (ii) wherein the drain pipe comprises a top edge and a bottom edge, each of the top and bottom edges being bifurcated by a v-shaped notch; (iii) wherein lengths of adjacent drain pipe are connected to one another via a frictional fitted clip positioned at the end of two (2) lengths of drain pipe; and (iv) wherein a portion of the clip is disposed within either of the v-shaped notches formed on the drain pipe.

15. The water drainage system of claim 14 wherein a portion of the clip is disposed within the lower v-shaped notch formed on the drain pipe and a portion of the clip is frictionally engaged with the upper outer angled of the drain pipe.

16. The water drainage system of claim 15 comprising the one or more standoffs in at least two (2) vertically displaced rows.

17. The water drainage system of claim 16 wherein the one or more standoffs are not continuous along a length of drain pipe.

* * * * *